United States Patent [19]

Bolduc

[11] Patent Number: 4,941,615

[45] Date of Patent: Jul. 17, 1990

[54] AEROSOL DISPENSER

[76] Inventor: Lee R. Bolduc, 6416 Gainsborough Dr., Raleigh, N.C. 27612

[21] Appl. No.: 251,806

[22] Filed: Oct. 3, 1988

[51] Int. Cl.[5] ..... B67B 7/24

[52] U.S. Cl. ..... 239/309; 222/80

[58] Field of Search ..... 222/82, 145, 154, 87, 222/88; 239/309, 272; 169/83

[56] References Cited

U.S. PATENT DOCUMENTS

| | | | |
|---|---|---|---|
| 315,610 | 4/1885 | Gee . | |
| 518,258 | 4/1894 | Lechartier | 169/83 |
| 1,536,144 | 5/1925 | Robinson | 169/83 |
| 1,587,598 | 6/1926 | Magg . | |
| 1,779,959 | 10/1930 | Bellocchio . | |
| 2,167,866 | 8/1939 | Bennett | 222/82 |
| 2,716,637 | 8/1955 | Bunting . | |
| 2,921,720 | 1/1960 | Malachick | 222/154 |
| 2,930,384 | 3/1960 | Strain et al. . | |
| 3,080,094 | 3/1963 | Modderno . | |
| 3,240,403 | 3/1966 | Modderno . | |
| 3,349,966 | 10/1967 | Schwartzman . | |
| 3,491,916 | 1/1970 | Graham . | |
| 3,591,089 | 7/1971 | Cronan | 239/304 |
| 3,638,786 | 2/1972 | Borecki et al. | 206/47 A |
| 3,648,899 | 3/1972 | Lukesch et al. | 222/82 |
| 3,658,719 | 4/1972 | McConnaughey . | |
| 3,679,102 | 7/1972 | Charle et al. | 222/192 |
| 3,718,235 | 2/1973 | Cronan . | |
| 3,773,264 | 11/1973 | Cronan | 239/304 |
| 3,791,980 | 2/1974 | Goldsmith . | |
| 3,966,087 | 6/1976 | Curry et al. . | |
| 4,121,772 | 10/1978 | Cronan | 239/304 |
| 4,201,316 | 5/1980 | Klingaman | 222/80 |
| 4,387,998 | 6/1983 | Szigeti | 366/130 |
| 4,465,183 | 8/1984 | Saito et al. | 206/222 |
| 4,491,250 | 1/1985 | Liebermann | 222/386.5 |
| 4,613,061 | 9/1986 | Meuresch | 222/82 |
| 4,682,689 | 7/1987 | Pereira et al. | 206/222 |

FOREIGN PATENT DOCUMENTS

| | | | |
|---|---|---|---|
| 1168772 | 9/1958 | France | 239/309 |
| 215493 | 11/1923 | United Kingdom | 169/83 |

OTHER PUBLICATIONS

Aerosol Age, Apr. 1986.

Aerosol Age, Sep. 1985, "Pressure Packs Ride Challenger".

*Primary Examiner*—Andres Kashnikow

*Assistant Examiner*—Kevin P. Weldon

*Attorney, Agent, or Firm*—Burd, Bartz & Gutenkauf

[57] ABSTRACT

An aerosol dispenser having a transparent container for storing a propellant and a first compound under pressure. A normally closed valve is mounted on top of the container to control the dispensing of the materials from the container. An ampule containing a second material separate from the first material until the ampule is broken is positioned generally longitudinally of the length of the container with a sleeve. A push rod connected to the valve has an inclined shoulder that cooperates with an edge of the sleeve or a ring to break the ampule when the valve is first moved to its open position. The push rod alternatively pivots an angle member pivotally supported on the sleeve to break the ampule. The materials are mixed within the container and are dispensed through a filter mounted on a dip tube leading to the valve.

35 Claims, 5 Drawing Sheets

AEROSOL DISPENSER

FIELD OF INVENTION

The invention relates to an aerosol spray container and dispenser for holding materials which must normally be maintained in separated conditions until immediately prior to use.

BACKGROUND OF INVENTION

Many compounds would be advantageously used if they could be dispensed from an aerosol container. Some of these compounds have a relatively short life and cannot be intermixed until just prior to use. Aerosol containers that include a frangible secondary container have been used to hermetically separate two chemical ingredients that must be mixed together immediately prior to spraying, such as a resinous paint and a catalyst. An inertia means, such as a steel ball, has been placed in the secondary container so that by shaking the entire aerosol container the inertia means shatters the secondary container allowing the two chemicals to be mixed together allowing a chemical mixture to be sprayed to a desired location. An example of this structure is shown by Cronan in U.S. Pat. No. 4,121,772.

An aerosol package shown and described in *Aerosol Age* April 1986 has an ampule that keeps the reactive compounds in the system separated until ready for use. When the valve is actuated, the ampule is broken and its contents mix with other chemicals and/or a propellant. The ampule is made of a frangible material, such as glass. A rod mechanism extends from the valve downwardly into the container. The lower end of the rod has a saddle that traps the ampule transversly against the bottom of the container. When the valve stem is depressed, the rod shatters the ampule. This aerosol system allows one to use an aerosol spray containing material such as cyanoacrylates. This material causes rapid deteriation of gaskets and has relatively short shelf life. The size of the ampule lying on the bottom of the container is limited by the diameter of the container and the diameter of the opening into the container. This limits the amount of material in the ampule that can be mixed with the material in the container.

SUMMARY OF INVENTION

The invention is directed to an aerosol dispenser that has a container for storing a propellant and materials, such as liquids and chemicals that are to be sprayed to a desired location. The dispenser stores two or more separated materials that are mixed together within the container immediately prior to use. A wide range of ratios of materials can be selected by using different size ampules for storing secondary materials. The dispenser can be effectively used with an aerosol spray containing cyanoacrylates. Ampule breaking structure associated with the spray control valve is manually operated to fracture the ampule thereby allowing the materials in ampule an container to mix with each other. The container can be transparent materials to permit visual inspection of the integrity of the ampule.

The container has an open top that is closed with a cap that supports a normally closed control valve. The control valve has a moveable tubular member which can be manually moved into the container to open the valve to allow propellant and material to be dispensed therefrom. A frangible ampule is located within the container for storing a second material separated and isolated from the first material. The ampule is an elongated closed glass vessel that is positioned longitudinally along the length of the container. The ampule is normally located in a generally upright position. An annular member, such as a sleeve or ring, located within the chamber has a passage for accommodating a portion of the ampule to retain it in a generally upright position. The ampule breaking structure has a push rod connected to the movable member of the valve. A closure member or button mounted on the tubular member prevents dispensing of materials from the container when the tubular member is first moved to break the ampule. The rod extends into the passage of the annular member adjacent the side of the ampule. The rod and annular member have cooperating surfaces so that when the movable member is first moved into the chamber the rod crushes or breaks the ampule whereby the second material is mixed with the first material in the chamber. After the ampule is broken the button valve is operated in a normal manner to dispense the mixed materials as a spray to a selected location.

A preferred embodiment of the aerosol dispenser has an elongated cylindrical transparent glass container having a bottom wall, an open top, and a chamber for storing a propellant and material such as a liquid. A cap mounted on the container closes the open top and supports a normally closed control valve. The control valve has an upwardly directed tubular stem that is closed with a closure member or button. The button is replaced with a nozzle so that when the stem is moved relative to a seal to open the valve the propellant and the material is dispensed from the container as a spray or jet through the nozzle.

An elongated frangible ampule is located within the chamber for storing a second material separate and isolated from the first material. A rigid cylindrical sleeve accommodates the lower end of the ampule to hold the ampule in a generally upright position in the chamber. This upright position is generally parallel to the longitudinal dimension or length of the chamber. The upright location of the ampule in the chamber allows a relatively large ampule to be stored within the chamber. This allows the aerosol dispenser to have a large range of ratios of the first and second materials. The second material in the ampule being separated and isolated from the first material in the container increases the shelf life of the product and minimizes the deteriation of the gasket and seal structures of the control valve. The sleeve has open upper and lower ends. The upper end of the sleeve has an inside annular downwardly tapered edge or chamber. A rod connected to the movable member extends downwardly into the passage of the sleeve. The rod has a downwardly directed finger that is located within the passage adjacent the ampule. A beveled shoulder on the rod adjacent to the finger cooperates with tapered edge on the sleeve to force the rod into the side of the ampule to break the ampule when the stem is moved down or depressed. The second material in the ampule flows into the chamber where it is mixed with the first material and propellant. A dip tube having a filter at the lower end thereof carries the mixed materials and propellant into the valve when the valve is open thereby allowing the mixed materials to be dispensed to a desired location. A valve actuator nozzle is provided with an elongated tube which allows the materials to be accurately dispensed to a desired location.

The objects and advantages of the aerosol dispenser of the invention are embodied in the dispenser structure and functions as shown in the drawing and described in the specification of the preferred embodiment thereof.

DESCRIPTION OF PREFERRED EMBODIMENTS

Figure 1:
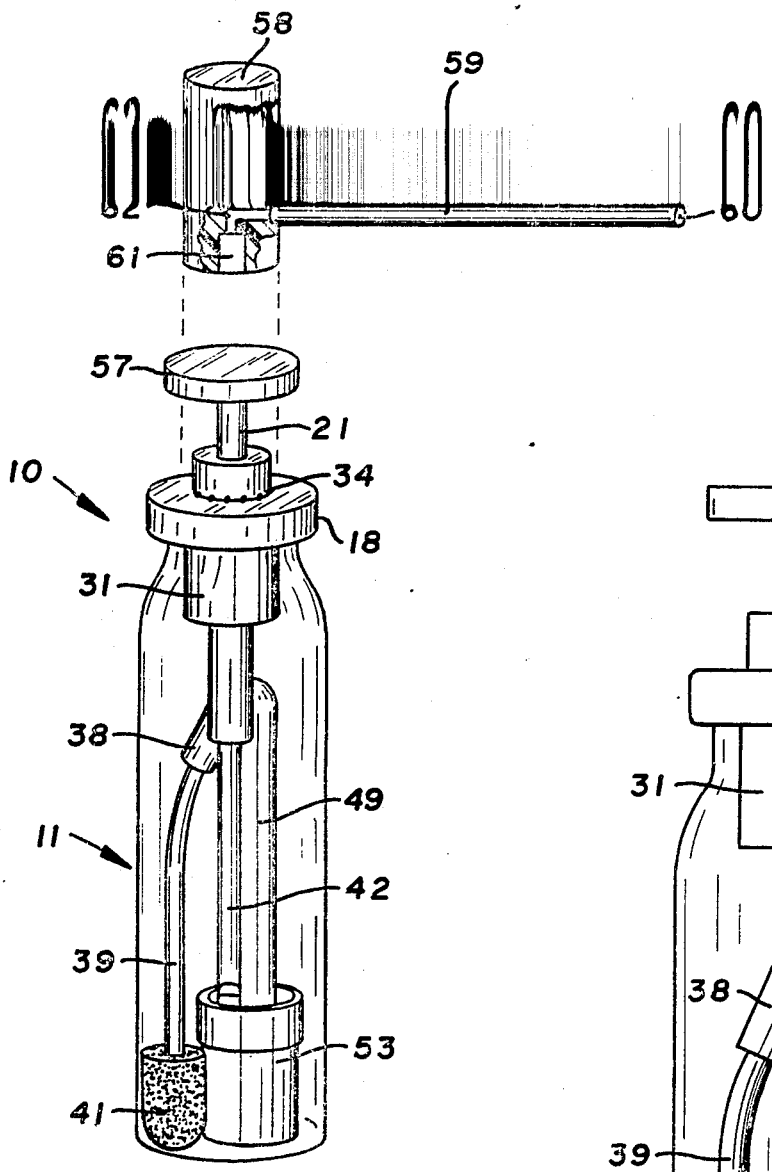
FIG. 1 is a perspective view of the aerosol dispenser of the invention equipped with an actuator button and a nozzle, partly sectional, having a dispensing tube for directing mixed materials to a desired location.
Figure 2:
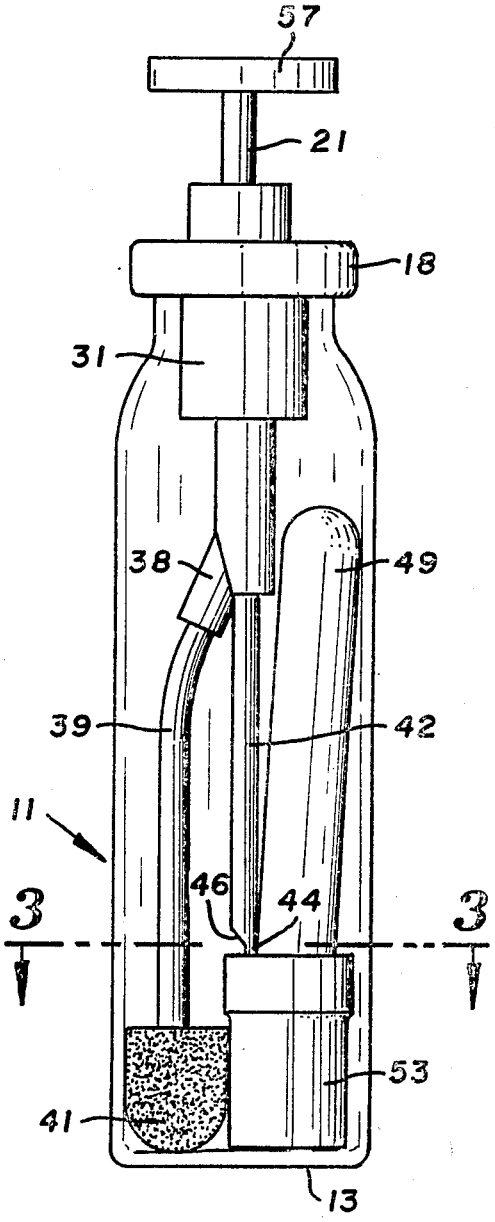
FIG. 2 is an enlarged front elevational view of FIG. 1.
Figure 3:
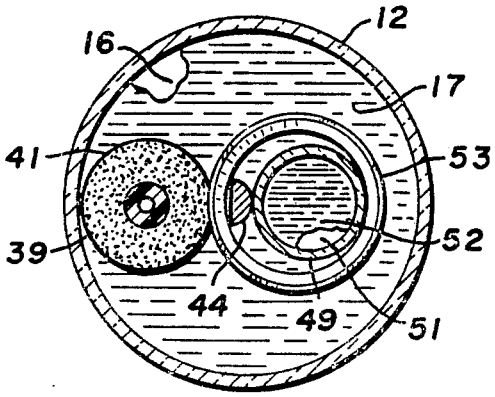
FIG. 3 is an enlarged sectional view taken along the line 3—3 of FIG. 2.

Referring to FIGS. 1, 2, and 3, there shown the aerosol dispenser 10 of the invention for delivering mixed materials with a propellant to a desired location. The materials within dispenser 10 are mixed immediately prior to use so that corrosive materials have a minimum effect on gaskets and sealing elements of the control valve. The dispenser 10 has substantial shelf life since there is little or no reaction within the container prior to the mixing of the materials within the container. The dispenser can be used with materials such as cyanoacrylates.

Dispenser 10 has an external bottle or container 11 made out of transparent material such as glass, plastic or the like. Bottle 11 has a cylindrical side wall 12 joined to a generally flat bottom wall 13. The top of side wall 12 has an annular rim or bead 14 surrounding the opening or mouth into chamber 16 of container 11. A material 17 such as a liquid, is normally stored in a chamber 16 along with a propellant which maintains material 17 under pressure within chamber 16. The open top of the container 11 is closed with a cap 18 that supports a normally closed control valve indicated generally at 19.

Figure 4:
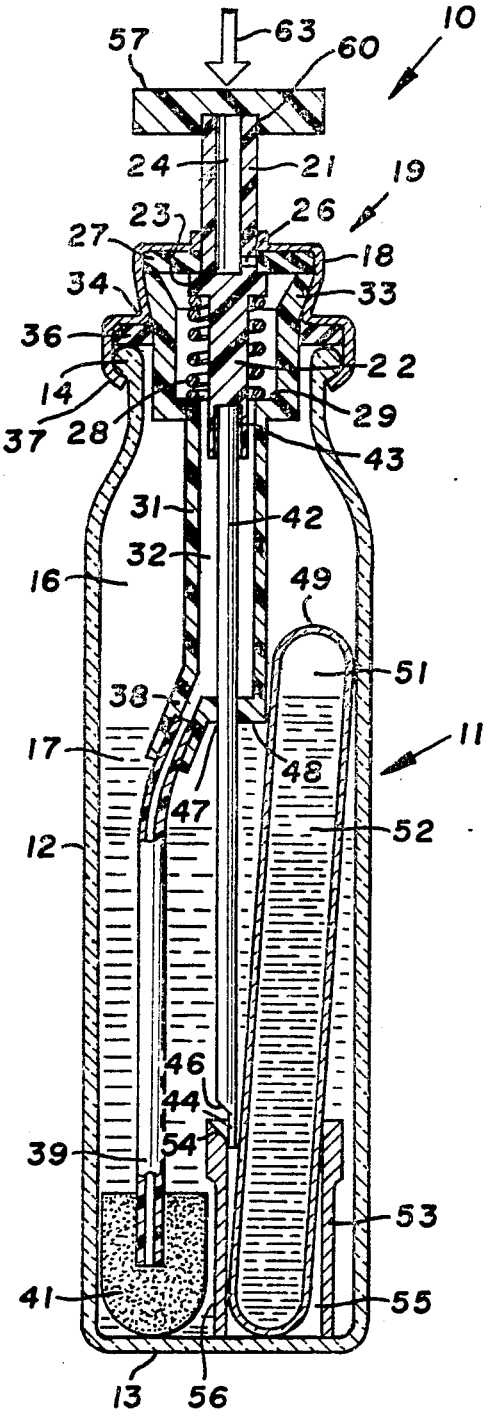
FIG. 4 is an enlarged longitudinal sectional view of the dispenser of FIG. 2.

As shown in FIG. 4, control valve 19 has a generally upright tubular stem 21 that projects upwardly from cap 18. The lower portion of stem 21 has an elongated body 22 having an outwardly directed annular flange 23. Stem 21 has a passage 24 open to the top of the stem and open to a side port 26 that allows the propellant and the material to flow into passage 24. An annular diaphram 27 surrounding stem 21 is normally aligned with the side port 26 to maintain the valve in a closed position. A coil spring 28 engages flange 23 to hold stem 21 in an up or closed position. The lower or inner end of coil spring 28 bears against an annular shoulder 29 of a generally cup-shaped housing 31 that surrounds stem body 22. Housing 31 has an internal chamber 32 that allows the propellant and material to flow upwardly to the side port 26 when control valve 19 is in the open position. Spring 28 biases stem 21 in a closed position as shown in FIG. 4. The upper end of housing 31 has a outwardly directed annular lip 33 that bears against the bottom of diaphram 27. Cap 18 is provided with an inwardly directed annular crimp 34 to hold lip 33 in engagement with diaphram 27. This also holds housing 31 on cap 18. An annular gasket 36 surrounds housing 31 and bears against the top of the bead 14 of container 11. Gap 18 is turned about or clamped over the gasket 36 and bead 14 to seal cap 18 on container 11.

The lower portion of housing 31 has a laterally and downwardly directed nipple 38 that is secured to an elongated dip tube 39. Tube 39 extends to adjacent the bottom wall 13 of container 11. A cup-shaped filter 41 fits over the lower end of dip tube 31 to prevent particulates, such as glass particles and the like, from flowing into the valve and being dispensed from the dispenser. Filter 41 is a porous polyethylene generally cylindrical member. The pore size of filter 41 is in the range of 45 to 75 microns. The bottom of filter 41 has a semi-spherical shape. The lower end of dip tube 39 fits into a hole extended down into filter 41. Other types of filters can be used with dip tube 39 to prevent foreign particles from interferring with the operation of control valve 19.

The lower portion of body 22 is secured to a downwardly directed compression or push rod 42. Push rod 42 is an elongated rigid member having a smooth outer cylindrical outer surface joined to the bottom part of stem 21 so that rod 42 moves with stem 21. Rod 42 is a stainless steel wire rod having a continuous and smooth cylindrical outer surface. Other types of materials can be used to make rod 42. The upper end of rod 42 fits into a hole or recess 43 in the bottom of body 22. Rod 42 extends downwardly through a hole 47 in bottom wall 48 of housing 31. Rod 42 is in a close sliding fit relation with bottom wall 47 to prevent foreign particles from entering passage 32. Spring 28 also serves as a stop to limit the depression or inward movement of stem 21. Stem 22 has a diameter that is smaller than the diameter of passage 32 so that the propellant and liquid can freely flow to side port 26 when port 26 is moved below diaphram 27 to allow the material to flow through the valve and be dispensed to a desired location.

As shown in FIGS. 2 to 5, the bottom of rod 42 has a downwardly directed finger 44. Finger 44 has a width less than one half the diameter of rod 42. Finger 44 is located adjacent a wedge or shoulder surface 46 on the lower end of rod 42. The surface 46 is preferably at an angle of 45 degrees relative to the longitudinal axis of rod 42. Other angles can be used for wedge shoulder 46. Finger 44 extends downwardly generally parallel to the longitudinal axis of rod 42. The upper end of finger 44 has opposite side edges that diverge upwardly to the opposite side edges of shoulder 46.

An elongated cylindrical frangible ampule 49 having a sealed chamber 51 storing a second material 52 such as liquid, chemical, powders, and the like that is desired to be mixed with material 17 in chamber 16 immediately prior to use of the dispenser. Ampule 49 is a glass vessel located generally along the length of chamber 16. This allows a relatively large ampule to be located within chamber 16 so that a wide range of ratios of amounts of materials can be mixed in chamber 16. The diameter of ampule 49 is smaller than the diameter of the opening into chamber 16. The length of ampule 49 can be substantially the same as the longitudinal length of chamber 16. The size of ampule 49 is selected to provide the desired ratio of volumes of material 17 to material 52.

Ampule 49 is retained in its generally upright or longitudinal position with a cylindrical sleeve or holding member 53. Sleeve 53 bears against the bottom wall 13 of container 11 and has a passage 55 that accommodates a lower end of ampule 49. Sleeve 42 is a one-piece cylindrical metal member having an outside diameter slightly smaller than the opening into chamber 16 whereby sleeve 53 can be placed into chamber 16. As seen in FIG. 4, sleeve 53 has inwardly directed annular chamfer or beveled edge 54 at the top end thereof. The lower outside wall of sleeve 53 has an annular groove 56 providing space for filter 41 whereby sleeve 53 and filter 41 are located adjacent bottom wall 13 of container 11. Preferably, the angle of edge 54 is at 45 degrees relative to the longitudinal axis of the passage 55 of sleeve 53. Other angles can be used for 54. Sleeve 53 has open top and bottom ends so that material is not trapped in passage 55. Finger 44 is located in the upper end of sleeve 53 when valve 19 is in the closed position. Wedge shoulder 46 is spaced from edge 54. Finger 44 is located contiguous to the side wall of ampule 49. Ampule 49 is not broken so that the material 52 therein is isolated from material 17 in chamber 16. The structural condition of ampule 49 can be visually observed through the transparent material of container 11.

The upper end of stem 22 accommodates a generally circular button or closure member 57 that closes passage 24. The bottom of button 57 has a central circular recess or hole 60 that accommodates the upper end of stem 21. Button 57 has a tight fit on stem 21. Button 57 is used to apply force as indicated by arrow 63 in FIG. 4 in a downward direction on stem 21. This moves valve 19 to the open position and rod 42 in a downward direction as indicated by arrow 64 in FIG. 5. Button 57 prevents materials and propellant under pressure in chamber 16 from being discharged from stem 21. The wedge shoulder 46 engages edge 54 causing the lower end of rod 42 to move laterally into tight engagement with the side of ampule 49. Continued downward movement of rod 42 continues to exert lateral force on the ampule 49 and wedges the lower end of rod 42 between the inside of wall of sleeve 3 and ampule 49. This force of rod 42 against ampule 49, indicated by arrow 65 in FIG. 5, fractures or breaks ampule 49 thereby releasing material 52 into chamber 16 where it is mixed with material 17. The mixing of the materials can be facilitated by shaking dispenser 10. The sleeve 53 is free to move up and down as indicated by the arrow 66. This allows the materials in passage 55 to be thoroughly mixed with all of the material in chamber 16.

As soon as ampule 49 is broken, the external force 63 on button 57 can be removed. Spring 28 will then move stem 21 to its closed position as shown in FIG. 4. Button 57 is then removed from stem 21 and replaced with a cap actuator 58. As shown in FIG. 1, cap actuator 58 has a elongated lateral tube 59 having a discharge orfice 60. The bottom of cap 58 has a bore 61 that telescopes over the top of stem 21. Bore 61 is to open to a passage 62 that leads laterally to tube 59. Other types of cap actuators and discharge nozzles can be used with stem 21 to direct the aerosol spray to desired locations.

Dispenser 10 is stored and transported in the manner shown in FIGS. 1 and 2. A cover (not shown) can be placed over button 57 and fitted on cap 18. The control valve 19 is closed thereby confining the liquid 17 and propellant under pressure to chamber 16. Ampule 49 being a hermetically sealed vessel separates and isolates the material 52 from the material 17 and propellant in chamber 16. This substantially increases the shelf life of liquids 17 and 52 and minimizes deteriation of the seal materials of control valve 19. The separation of the first and second materials also allows the dispenser to use cyanoacrylates.

The cylinder 53 and sealed ampule 49 containing liquid 52 are placed in chamber 16 through the top opening before the cap 18 is attached to rim 14. Cap 18 and control valve 19 are placed on top of container 11 as a unit. The rod 42 extends down into chamber 16 to locate finger 44 within the top of sleeve 53 adjacent the side of ampule 49. Material 17 can be placed in chamber 16 before cap 18 is placed on container 11. Propellant can be introduced into chamber 16 through stem 21 by opening valve 19.

Figure 5:
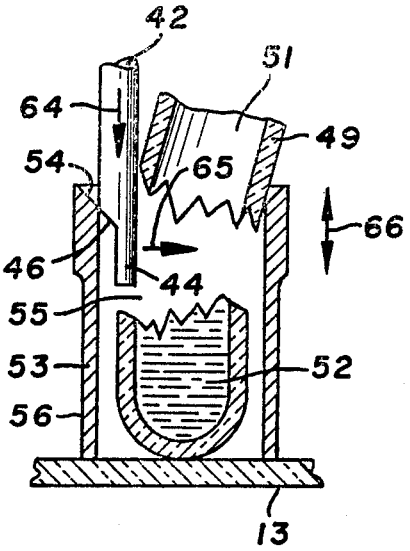
FIG. 5 is an enlarged sectional view showing the breaking of the ampule with the push rod in the sleeve within the container.

In use the operator applies force 63 on button 57 to move stem 21 down into container 11. This opens the control valve 19 and moves push rod 42 down into sleeve 53. Button 57 mounted on the upper end of stem 21 prevents material and propellant under pressure in chamber 16 from being discharged from stem 21. The shoulder 46 engages beveled edge 54 of sleeve 53 to force rod 42 laterally to break ampule 49, as shown in FIG. 5. Material 52 in ampule 49 mixes with material 17. Button 57 is replaced with cap actuator 58. Dispenser is now ready for use to dispense a spray or jet of mixed materials and propellant to a location.

Referring to FIGS. 6 to 10, there is shown a first modification of the dispenser of the dispenser of the invention indicated generally at 110. Dispenser 110 has a container or bottle 111 made out of transparent materials such as glass including a generally cylindrical side wall 112 and a bottom wall 113. Container 111 has an internal closed chamber 116 that stores a first material such as a liquid and propellant. A cap 118 closes the mouth of the container and supports a normally closed control valve (not shown). The control valve has the same structure as the control valve 19 shown in FIG. 4. The control valve includes an upwardly directed tubular stem 121 that accommodates a button or closure member 157 that normally closes the stem.. The stem 121 extends downwardly through the valve and is joined to a downwardly directed body 122 that has a recess or hole 143 for a downwardly directed push rod 142. A valve housing 131 has a laterally directed nipple 138 that is joined to a dip tube 139. The lower end of dip tube 139 fits into a filter 141. Filter 141 has the same structure as the filter 41 shown in FIG. 3.

Figure 7:
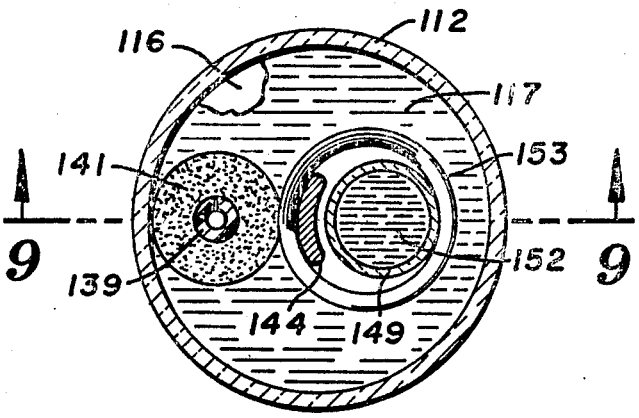
FIG. 7 is an enlarged sectional view taken along the line 7—7 of FIG. 6.
Figure 9:
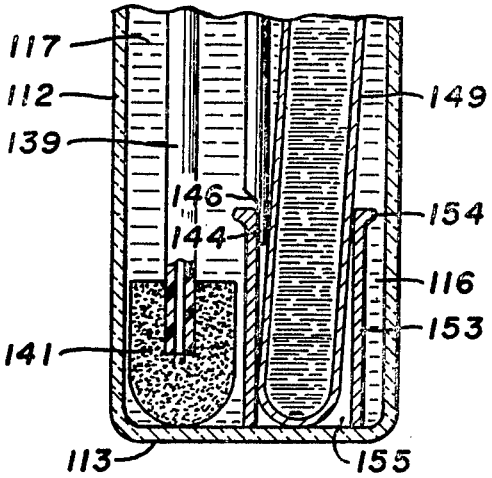
FIG. 9 is a longitudinal sectional view of the lower section of the dispenser of FIG. 1 showing the integrity of the ampule within the container.
Figure 8:
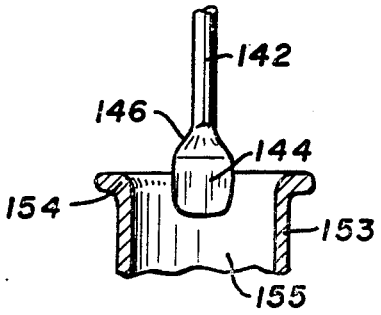
FIG. 8 is an enlarged sectional view taken along the line 8—8 of FIG. 6.

Push rod 142 is an elongated cylindrical metal member. The lower end of the member is flattened to form a finger 144. When finger 144 is formed by forging, a downwardly inclined shoulder or wedge surface 146 is formed at the upper end of the finger and lower end of the cylindircal rod 142. The finger 144 is formed into a generally arcuate configuration as shown in FIG. 7 and is located adjacent a side portion of an ampule 149. Ampule 149 has a sealed chamber 151 that contains a second material 152 such as a liquid that is to be mixed with the liquid 117 in the chamber 116.

Finger 144 extends downwardly into a sleeve or annular member 153. Member 153 has a top annular bead or rim 154 that has an inside edge that engages the shoulder 146 when the push rod 142 is moved down. Ampule 149 extends in a generally upright position in a passage 155 of sleeve 153. The sleeve 153 holds the ampule 149 generally parallal to the longitudinal axis or length of chamber 116 so that a relatively large ampule 149 can be placed in chamber 116.

Figure 10:
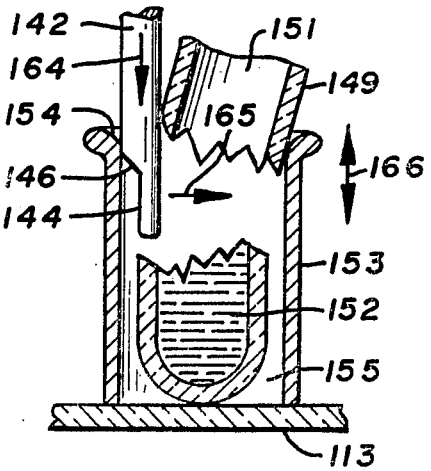
FIG. 10 is an enlarged longitudinal sectional view showing the breaking of the ampule with the push rod.

Referring to FIG. 10, when push rod 142 is moved down the shoulder 146 will ride on the inside surface the bead 154 causing the push rod finger 144 to move laterally as indicated by the arrow 165. This will break the frangible material of the ampule 149. The material 152 is then free to mix to the material 117 in chamber 116. This is facilitated by shaking the container 111 as indicated by the arrow 166.

Figure 6:
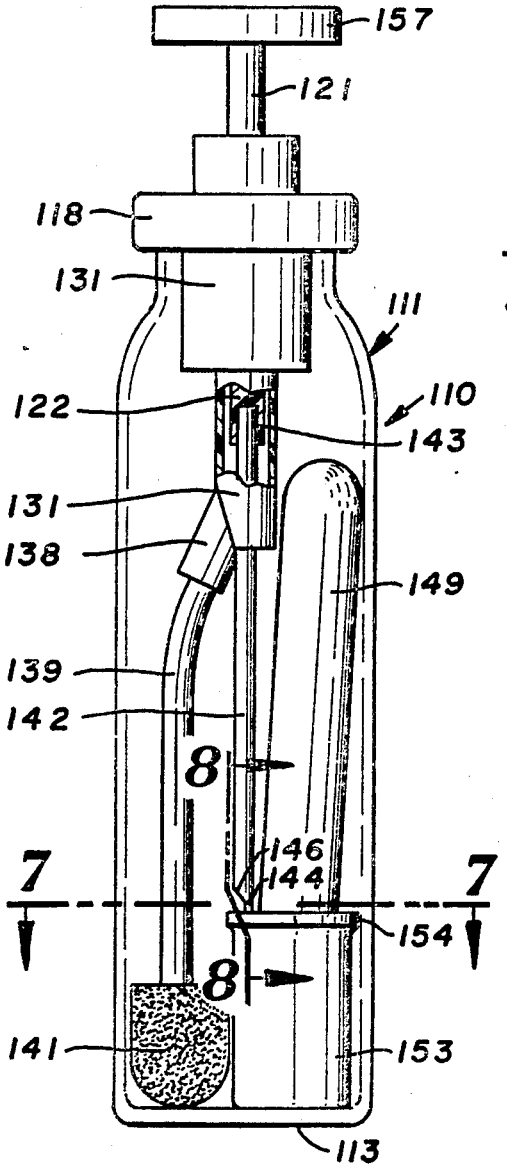
FIG. 6 is a front elevational view of a first modification of the aerosol dispenser of the invention.

As seen in FIG. 6 the transparent bottle 111 allows the user to visually observe the sealed and or broken condition of ampule 149. The button 157 is removed from stem 121 replaced with a nozzle such as nozzle 58 shown in FIG. 1 so that the mixed material can be dispensed to desired location.

Figure 11:
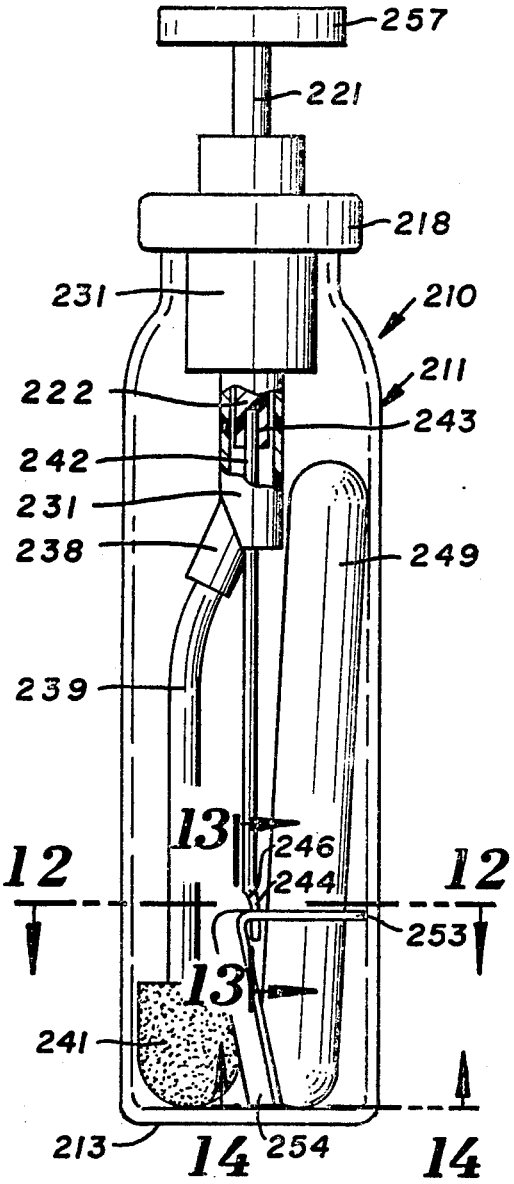
FIG. 11 is a front elevational of a second modification of the aerosol dispenser of the invention.
Figure 12:
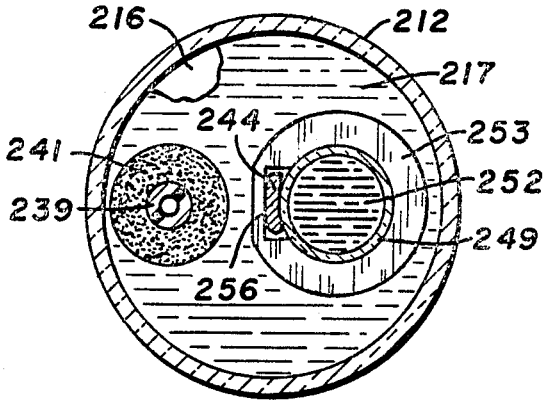
FIG. 12 is an enlarged sectional view taken along the line 12—12 of FIG. 11.
Figure 15:
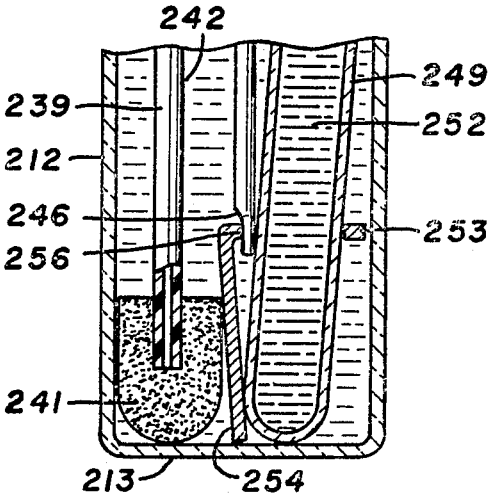
FIG. 15 is an enlarged longitudinal sectional view of the lower section of the dispenser of FIG. 11 showing the ampule in stored unbroken condition.
Figure 13:
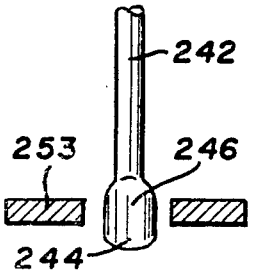
FIG. 13 is an enlarged sectional view taken along the line of FIG. 11.

Referring to FIGS. 11 to 16 there is shown a second modification of the dispenser of the invention indicated generally at 210. Dispenser 210 has structure that corresponds to dispenser 10 as shown in FIGS. 1 to 6 that is indicated by the reference numerals having a suffix 2. Dispenser 210 has a container of bottle 211 of tranparent material including a side wall 212 and bottom wall 213 surrounding a chamber 216. A first material such as a liquid 217 and a propellant is stored under pressure in chamber 216. A cap 218 mounted on the top of container 211 closes the mouth of the container and supports a normally closed control valve (not shown). The control valve located within a housing 231 has an upwardly directed tubular stem 221 and a downwardly extended body 222 joined to stem 221. Housing 231 has a laterally directed nipple 238 that is connected to a dip tube 239. A filter 241 is mounted on the bottom of dip tube 239. Filter 241 is identical in structure and function to the filter 41 shown in FIG. 3. An elongated generally cylindrical push rod 242 has an upper end that fits into a hole or recess 243 in the end of body 222. Push rod 241 ends through the bottom of housing 231 and terminates in a downwardly directed generally flat finger 244. Finger 244 is formed by forging or pressing the end of the rod to a generally flat shape. As seen in FIG. 12 the finger 244 has a slight transverse curve that follows the curvature of the side wall of the ampule 249. The lower end of push rod 242 also contains downwardly and inwardly directed shoulder or wedge surface 246 that are formed during the forging of finger 244.

Figure 14:
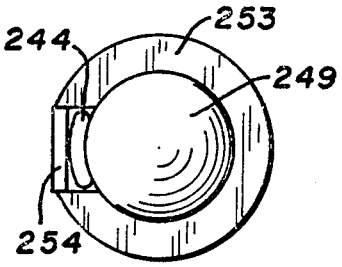
FIG. 14 is an enlarged sectional view taken along the line 14—14 of FIG. 11.
Figure 16:
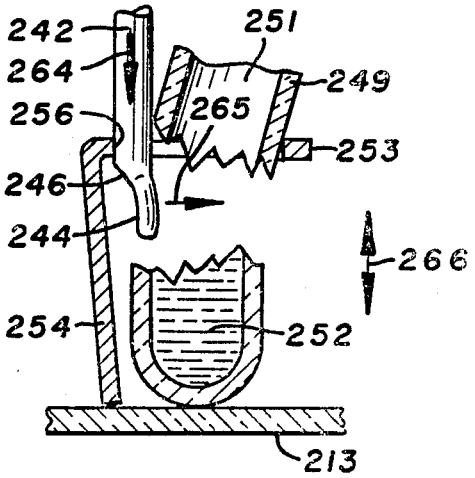
FIG. 16 is an enlarged sectional view showing the breaking of the ampule with the push rod.
Figure 17:
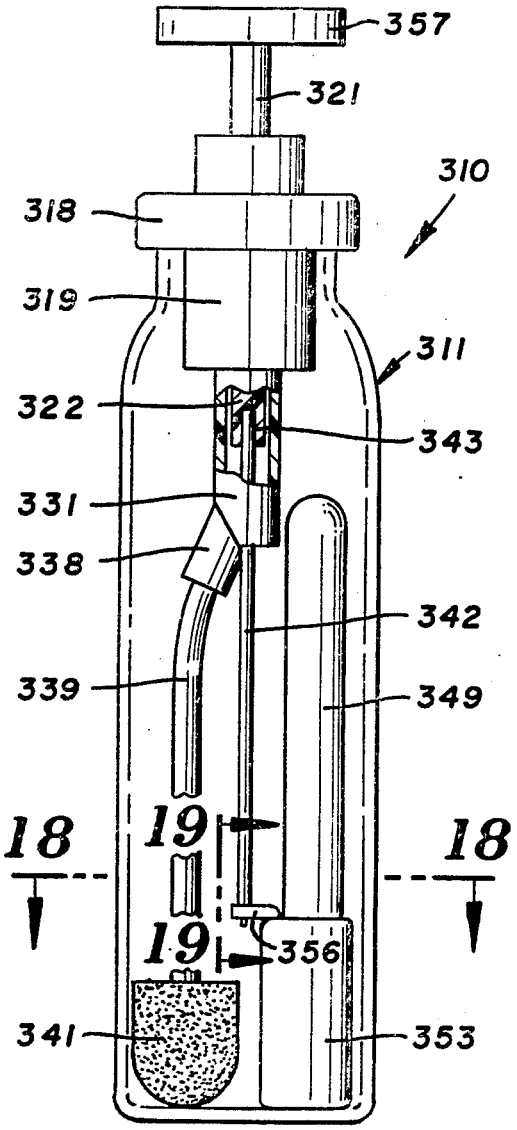
FIG. 17 is a front elevational view of a third modification of the aerosol dispenser of the invention.
Figure 18:
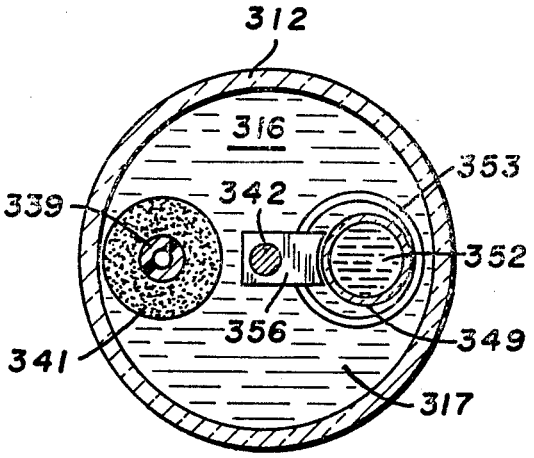
FIG. 18 is an enlarged sectional view taken along the line 18—18 of FIG. 17.

Ampule 249 is an elongated cylindrical glass vessel that has a sealed internal chamber 251 containing a second material or liquid 252. The ampule fits into a annular member or holder 253. Holder 253 is a generally flat ring joined to a downwardly directed leg 254. As seen in FIG. 14 leg 254 has a generally arcuate configuration that follows the outside curvature of ampule 249. Leg 254 is bent inwardly to frictionally retain the ampule 249 in the generally upright position or along the longitudinal length of the chamber 216.

The transparent material of container 211 allows for the visual inspection of the integrity of ampule 249 as seen in FIG. 11. When the push rod 242 is moved in a downward direction by applying force on the button 257 the shoulder 246 engages the edge 256 of annular member 253. The continued downward movement of push rod 242, as indicated by arrow 264 in FIG. 16, causes the finger 244 to move in the lateral direction as indicated by the arrow 265. This will break the frangible material of ampule 249. The second material 252 will then mix with the material 217 in chamber 216. The mixing is facilitated by shaking the container as indicated by the arrow 266.

Referring to FIG. 17 to 21 there is shown in a third modication of the dispenser of the invention indicated generally at 310. Dispenser 310 has a structure that is similar to the structure of dispenser 10 of FIGS. 1 to 6 which structure has same reference numerals with a suffix 3.

Dispenser 310 has a transparent container of bottle 311 having a side wall 312 and a bottom wall 313 surrounding a chamber 316. A first material 317 such as a liquid and propellant under pressure is stored in chamber 316 and retained therein with a cap 318. Cap 318 supports a normally closed control valve 319 that is identical in structure to the valve 19 shown in FIG. 4. The control valve 319 has an upwardly directed tubular stem 321 and a downwardly directed body 322. A cap 357 fits on top of stem 321 to close the exit passage in the stem. Control valve 319 is surrounded with a housing 331 having a lateral nipple 338. A downwardly extended dip tube 339 is joined to nipple 338 and a filter 341. Filter 341 is identical in structure and function to the filter 41 shown in FIG. 3.

Figure 20:
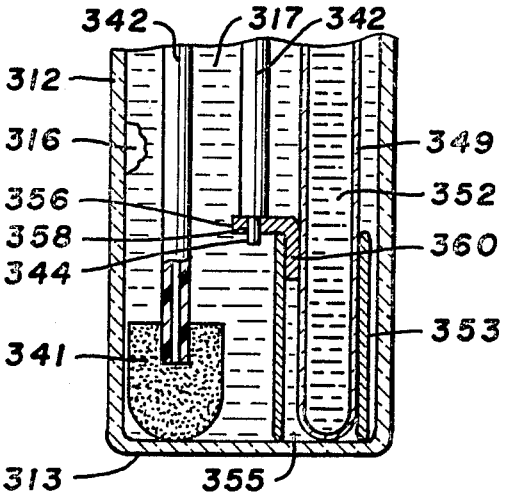
FIG. 20 is an enlarged longitudinal section view of the lower portion of the dispenser FIG. 17 showing the ampule in its stored unbroken condition.
Figure 19:
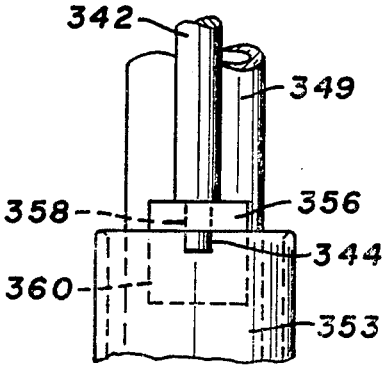
FIG. 19 is an enlarged sectional view taken along the line 19—19 of FIG. 17.
Figure 21:
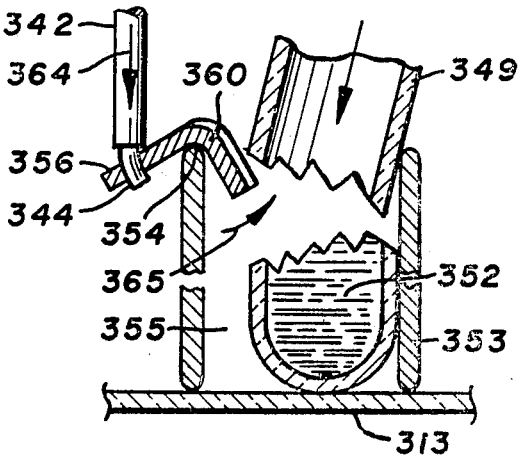
FIG. 21 is an enlarged sectional view similar to FIG. 20 showing the breaking of the ampule with the push rod and angle member.

An elongated rigid push rod 342 extends upwardly into housing 331 and into a recess 343 in the bottom of body 322 so that the push rod 342 moves with stem 321. The lower end of push rod 342 has a finger 344 extended downwardly adjacent to the side of an ampule 349 made of frangible material such as glass. Ampule 349 stores a second material or liquid 352 that is to be mixed with the material 317 in chamber 316 to provide the desired mixture of materials that is to be dispensed from the dispenser. Fingers 344 as seen in FIG. 20 fits into a hole 358 in an angle member 356. Member 356 is pivotally mounted on top of a sleeve 353. The lower end of ampule 349 extends into the passage 355 of sleeve 353. Member 356 has a downwardly directed leg 360 extended into passage 355 adjacent ampule 349 as shown in FIG. 20. Leg 360 has a convex curve to accommodate the curvature of ampule 349. The vertex of member 356 engages the upper edge 354 of sleeve 353 so that member 356 is supported on sleeve 353 for pivotal movement about a generally horizontal axis. The upper edge 354 of sleeve 353 is rounded to promote the pivoted movement of member 356. The lower ede of sleeve 353 is also rounded so that the orientation of sleeve 353 in container 311 is not critical When downward force is applied to cap 357, stem 321, body 322, and rod 342 move downward as indicated by arrow 364 in FIG. 21. Member 356 pivots on upper edge 354 forcing leg 360 into the side of ampule 349 as shown by arrow 365 to break the ampule. The material 352 flows out of ampule 349 and mixes with material 317 in container 312. After the ampule 349 is broken, cap 357 is removed from stem 321 and replaced with a nozzle such as nozzle 58 shown in FIG. 1.

While there has been shown and described of preferred embodiments of the aerosol dispenser of the invention it is understood that changes in the structures, arrangement of structures, and materials may be made by those skilled in the art without departing from the invention. The invention is defined in the following claims.

What is claimed is:

1. An aerosol dispenser comprising: a container having a bottom wall, an open top, and a chamber for storing a propellant and first material under pressure, a cap mounted on the container closing said open top, a housing extended into the chamber through said open top, said housing having a passage, control valve means mounted on the cap and housing operable to control the flow of propellant and material from said passage, said control valve means normally closed and having a movable member extended into the passage which can be moved to open said valve means whereby propellant and materials are dispensed from the container, a dip tube connected to the housing extended to the bottom portion of the chamber for carrying propellant and materials to the passage, a porous filter mounted on the dip tube to prevent foreign particles from flowing into the passage whereby when said valve means is open the propellant and materials in said chamber flow through the filter and dip tube into the passage, frangible ampule means located within said chamber storing a second material separate from the first material until the ampule means is broken, sleeve means located in said chamber surrounding a portion of the ampule means, rod means connected to the movable member extended into said sleeve means, said rod means and sleeve means having engagable means whereby when the movable member is first moved to open the valve means the ampule is broken whereby the second material is mixed with the first material in said chamber.

2. The dispenser of claim 1 wherein: the container includes a transparent side wall whereby the condition of the frangible ampule means can be visually inspected.

3. The dispenser of claim 1 including: biasing means engagable with the movable member and housing to bias the valve means to its closed position.

4. The dispenser of claim 1 wherein: the housing has a wall having a hole, said rod means extended through said hole into the top of the sleeve means.

5. The dispenser of claim 1 wherein: said movable member includes a tubular stem projected upwardly from the cap, and a button mounted on the stem closing said tubular stem whereby when the movable member is moved to open the valve means and break the ampule means propellant and materials are not discharged from the dispenser, said button being removable from said stem thereby opening the tubular stem so that propellant and materials can be discharged from the dispenser when the valve means is opened.

6. The dispenser of claim 5 including: nozzle means mounted on the tubular stem after the button has been removed from the stem.

7. The dispenser of claim 1 wherein: said sleeve means comprises a cylindrical member surrounding said portion of the ampule means.

8. The dispenser of claim 1 wherein: said sleeve means includes a ring surrounding the ampule means and a leg joined to the ring extended downwardly into engagement with the ampule means, said rod means engagable with the ring during the breaking of the ampule means.

9. The dispenser of claim 1 wherein: said sleeve means includes a cylindrical member engagable with the bottom wall of the container, said cylindrical member surrounding said portion of the ampule means, an angle member pivotally mounted on top of the sleeve means, said angle member having a leg extended into said cylindrical member adjacent the ampule means, said rod means engagable with the angle member during the breaking of the ampule means.

10. An aerosol dispenser comprising: a container having a bottom wall, an open top, and a chamber for storing a propellant and first material under pressure, a cap mounted on the container closing said open top, a housing extended into the chamber through said open top, said housing having a passage, control valve means mounted on the cap and housing operable to control the flow of propellant and material from said passage, said control valve means being normally closed and having a movable member extended into the passage which can be moved to open said valve means whereby propellant and materials are dispensed from the container, a dip tube connected to the housing extended to the bottom portion of the chamber for carrying propellant and materials to the passage, a porous filter mounted on the dip tube to prevent foreign particles from flowing into the passage whereby when said valve means is open the propellant and materials in said chamber flow through the filter and dip tube into the passage, frangible ampule means located within said chamber storing a second material separate from the first material until the ampule means is broken, sleeve means located in said chamber surrounding a portion of the ampule means, rod means connected to the movable member extended into said sleeve means, said rod means and sleeve means having engagable means whereby when the movable member is first moved to open the valve means the ampule means is broken whereby the second material is mixed with the first material in said chamber, said engagable means comprises an inwardly and downwardly sloping edge on the sleeve means and an inwardly and downwardly sloping shoulder on said rod means facing said edge, said shoulder and edge being engagable with each other when the movable member is moved to open the valve means and move the rod means laterally thereby breaking the ampule means.

11. The dispenser of claim 10 including: a finger on said rod means extended downwardly from said shoulder into the sleeve means adjacent said ampule means.

12. An aerosol dispenser comprising: a container having an internal chamber for storing a propellant and at least one first component to be sprayed therefrom, normally closed valve means mounted on said container to retain the propellant and component is said chamber, said valve means being movable to an open position to dispense aerosol to a desired location, frangible ampule means located with said chamber containing a second component that is separated from the first component within the chamber until said ampule means is broken, means for holding the ampule means in said chamber generally along the length of said chamber, and means mounted on said valve means engagable with said means for holding the ampule means and said ampule means to break said ampule means when the valve means is first moved to the open position thereby releasing the second component into said chamber whereby the first and second compounds are mixed together, said means engagable with said means for holding the ampule means comprises a sleeve, said means mounted on the valve means including a push rod connected to the valve means, said push rod having a portion engagable with said sleeve on movement of the valve means to the open position to break the ampule means, said sleeve has in inwardly and downwardly sloping top edge, said push rod portion including a downwardly and inwardly sloping shoulder facing said edge, said shoulder being engagable with said edge when the valve means is moved to the open position to break the ampule means.

13. The dispenser of claim 12 including: a finger on said push rod extended downwardly from said shoulder between the sleeve and the ampule means.

14. The dispenser of claim 12 including: means for preventing the dispensing of aerosol when the valve means is first moved to the open position to break said ampule means.

15. An aerosol dispenser comprising: a container having an internal chamber for storing a propellant and at least one first component to be sprayed therefrom, normally closed valve means mounted on said container to retain the propellant and component in said chamber, said valve means being movable to an open position to dispense aerosol to a desired location, frangible ampule means located with said chamber containing a second component that is separated from the first component within the chamber until said ampule means is broken, means for holding the ampule means in said chamber generally along the length of said chamber, and means mounted on said valve means engagable with said means for holding the ampule means and said ampule means to break said ampule means when the valve means is first moved to the open position thereby releasing the second component into said chamber whereby the first and second compounds are mixed together, said means for holding the ampule means includes a sleeve surrounding the ampule means and a leg joined to the sleeve extended downwardly into engagement with the ampule means, said means mounted on the valve means being engagable with the sleeve during the breaking of the ampule means.

16. An aerosol dispenser comprising: a container having an internal chamber for storing a propellant and at least one first component to be sprayed therefrom, normally closed valve means mounted on said container to retain the propellant and component in said chamber, said valve means being movable to an open position to dispense aerosol to a desired location, frangible ampule means located with said chamber containing a second component that is separated from the first component within the chamber until said ampule means is broken, means for holding the ampule means in said chamber generally along the length of said chamber, and means mounted on said valve means engagable with said means for holding the ampule means and said ampule means to break said ampule means when the valve means is first moved to the open position thereby releasing the second component into said chamber whereby the first and second compounds are mixed together, said means for holding the ampule means includes a sleeve engagable with the bottom wall of the container, said sleeve surrounding a portion of the ampule means, an angle member located adjacent the ampule means and pivotally supported on the sleeve, said angle member located adjacent said ampule means, said means mounted on said valve means being engagable with the angle member to pivot the angle member into the ampule means thereby breaking the ampule means.

17. An aerosol dispenser comprising: a container having an internal chamber for storing a propellant and a first material, normally closed valve means mounted on said container to retain the propellant and first material in said chamber, said valve means being movable to an open position to dispense aerosol to a desired location, at least one frangible ampule means located in the chamber containing a second material separate from the first material, means holding the ampule means in said chamber generally along the length of the chamber, and means having a portion thereof engagable with said means for holding the ampule means and said portion also being engagable with said ampule means operable to break said ampule means thereby release the second material into said chamber whereby the first and second materials are mixed together.

18. The dispenser of claim 17 wherein: the means holding the ampule means in said chamber comprises a sleeve surrounding an end portion of the ampule means.

19. The dispenser of claim 18 wherein: the portion engagable with said means for holding the ampule means includes a push rod having a portion engagable with said sleeve whereby on relative movement of the push rod and sleeve the push rod breaks the ampule means.

20. An aerosol dispenser comprising: a container having an internal chamber for storing a propellant and a first material, normally closed valve means mounted on said container to retain the propellant and first material in said chamber, said valve means being movable to an open position to dispense aerosol to a desired location, at least one frangible ampule means located in the chamber containing a second material separate from the first material, means holding the ampule means in said chamber generally along the length of the chamber, and means engagable with said means for holding the ampule means and ampule means operable to break said ampule means thereby release the second material into said chamber whereby the first and second materials are mixed together, said means holding the ampule means in said chamber comprises a sleeve surrounding an end portion of the ampule means, said means engagable with said means for holding the ampule means includes a push rod having a portion engagable with said sleeve whereby on relative movement of the push rod and sleeve the push rod breaks the ampule means, said sleeve has an inwardly and downwardly sloping to edge, said push rod portion including a downwardly and inwardly sloping shoulder facing said edge, said shoulder being engagable with said edge when the valve means is moved to the open position to break the ampule means.

21. The dispenser of claim 20 including: a finger on said push rod extended downwardly from said shoulder into the sleeve adjacent the ampule means.

22. The dispenser of claim 17 including: means for preventing the dispensing of aerosol when the valve means is first moved to the open position to break said ampule means.

23. An aerosol dispenser comprising: a container having an internal chamber for storing a propellant and a first material, normally closed valve means mounted on said container to retain the propellant and first material in said chamber, said valve means being movable to an open position to dispense aerosol to a desired location, at least one frangible ampule means located in the chamber containing a second material separate from the first material, means holding the ampule means in said chamber generally along the length of the chamber, and means engagable with said means for holding the ampule means and ampule means operable to break said ampule means thereby release the second material into said chamber whereby the first and second materials are mixed together, said means for holding the ampule means includes a sleeve surrounding the ampule means and a leg joined to the sleeve extended downwardly into engagment with the ampule means, said means mounted on the valve means being engagable with the sleeve during the breaking of the ampule means.

24. An aerosol dispenser comprising: a container having an internal chamber for storing a propellant and a first material, normally closed valve means mounted on said container to retain the propellant and first material in said chamber, said valve means being movable to an open position to dispense aerosol to a desired location, at least one frangible ampule means located in the chamber containing a second material separate from the first material, means holding the ampule means in said chamber generally along the length of the chamber, and means engagable with said means for holding the ampule means and ampule means operable to break said ampule means thereby release the second material into said chamber whereby the first and second materials are mixed together, said means for holding the ampule means includes a sleeve engagable with the bottom wall of the container, said sleeve surrounding a portion of the ampule means, a member located adjacent the ampule means and pivotally supported on the sleeve, said member having leg means extended into said sleeve adjacent said ampule means, said means mounted on said valve means being engagable with the member to pivot the member forcing the leg means into the ampule means thereby breaking the ampule means.

25. An aerosol dispenser comprising: a container having a transparent side wall, a bottom wall, an open top, and a chamber for storing a propellant and a first material under pressure, a cap mounted on the container closing said open top whereby the propellant and first material is stored in the chamber under pressure, a housing extended into the chamber through said open top said housing having a passage, control valve means mounted on the cap and housing operable to control the flow of propellant and materials from said passage, said control valve means being normally closed and having a movable body extended into the passage which can be moved to open said valve means whereby propellant and material are dispensed from the container, dip tube means connected to the housing extended to a bottom portion of the chamber for carrying propellant and materials to the passage, porous filter means mounted on the dip tube to prevent foreign particles from flowing into the passage whereby when the valve means is open the propellant and material in said chamber flow through the filter and dip tube into the passage, frangible ampule means located within said chamber generally along the length of the chamber for storing a second material separate from the first material until the ampule means is broken, a sleeve located in said chamber having a passage accomodating a portion of the ampule means, push rod means connected to the body, said push rod means having an end located adJacent the sleeve and ampule means, said sleeve having an inwardly and downwardly sloping edge, said end of the push rod having an inwardly and downwardly directed shoulder facing said edge of the sleeve whereby when the body is move to first open the valve means the shoulder engages the edge of the sleeve moving the end of the push rod into engagment with the ampule mean thereby breaking the ampule so that the second material is mixed with the first material in the chamber.

26. The dispenser of claim 25 including: biasing means engagable with said movable body and housing to bias the valve means to a closed position.

27. The dispenser of claim 25 wherein: said push rod includes a downwardly directed finger located within the passage of the sleeve adjacent the ampule mans.

28. The dispenser of claim 25 wherein: the housing has a wall having a hole, said push rod extended through said hole with a sliding fit.

29. The dispenser of claim 25 wherein: said movable body includes a tubular stem projected upwardly from the cap, and a button mounted on the stem closing said tubular stem whereby when the movable body is moved to open the valve means and break the ampule means propellant and materials within the chamber are not discharged from the dispenser, said button being removable from said stem thereby opening the tubular stem so that propellant and materials can be discharged from the dispenser when the valve means is open.

30. The dispenser of claim 29 including: nozzle means mounted on the tubular stem after the button has been removed from the stem for directing materials and propellant to a desired location.

31. Ths dispenser of claim 25 including: means for preventing the dispensing of propellant and material when the control valve means is first moved to the open position to break said ampule means.

32. An aerosol dispenser comprising: a container having an internal chamber for storing a propellant and at least one first component to be sprayed therefrom, normally closed valve means mounted on said container to retain the propellant and component in said chamber, said valve means having a member movable to an open position to dispense aerosol to a desired location, frangible ampule means located with said chamber containing a second component that is separated from the first component within the chamber until said ampule means is broken, means for holding the ampule means in said chamber, means mounted on said member of said valve means having a portion thereof engagable with said means for holding said ampule means and said ampule means to break said ampule means when the member has been moved to the open position thereby releasing the second component into said chamber whereby the first and second compounds are mixed together, said valve means having a tubular stem with an outlet passage for the propellant and materials in the chamber of the container, and means mounted on the stem for closing the outlet passage for preventing the dispensing of propellant and materials when the valve means is first moved to the open position to break said ampule means.

33. The dispenser of claim 32 wherein: the means mounted on said member of the valve means includes a push rod.

34. The dispenser of claim 32 wherein: the means mounted on the stem for closing the outlet passage comprises a button.

35. The dispenser of claim 34 wherein: said button has a recess accommodating a portion of the stem whereby the button is retained on the stem.

* * * * *